US008591070B2

(12) United States Patent
Erhard et al.

(10) Patent No.: US 8,591,070 B2
(45) Date of Patent: Nov. 26, 2013

(54) LIGHTING DEVICE HAVING A SOCKET AND BULB FITTING

(75) Inventors: Philipp Erhard, Mering (DE); Ulrich Henger, Eichenau (DE); Roland Huettinger, Kaufering (DE); Gerhard Mitic, München (DE); Wolfgang Pabst, Deisenhofen (DE)

(73) Assignee: OSRAM GmbH, Munich (DE)

( * ) Notice: Subject to any disclaimer, the term of this patent is extended or adjusted under 35 U.S.C. 154(b) by 85 days.

(21) Appl. No.: 13/254,962

(22) PCT Filed: Mar. 5, 2009

(86) PCT No.: PCT/EP2009/052626

§ 371 (c)(1),
(2), (4) Date: Sep. 6, 2011

(87) PCT Pub. No.: WO2010/099828

PCT Pub. Date: Sep. 10, 2010

(65) Prior Publication Data

US 2011/0317438 A1 Dec. 29, 2011

(51) Int. Cl.
*F21V 29/00* (2006.01)

(52) U.S. Cl.
USPC ..... 362/294; 362/249.02; 362/249.03; 362/652; 362/655

(58) Field of Classification Search
USPC ..... 362/294, 184, 249.02, 249.03, 655, 362/652; 439/620.02
See application file for complete search history.

(56) References Cited

U.S. PATENT DOCUMENTS

| | | | | |
|---|---|---|---|---|
| 6,903,380 | B2 | 6/2005 | Barnett et al. | |
| 7,988,336 | B1 * | 8/2011 | Harbers et al. | 362/294 |
| 7,993,031 | B2 * | 8/2011 | Grajcar | 362/294 |
| 8,117,395 | B1 * | 2/2012 | Rohana et al. | 711/128 |
| 8,227,963 | B2 * | 7/2012 | Paik | 313/46 |
| 2008/0130275 | A1 * | 6/2008 | Higley et al. | 362/184 |
| 2008/0274641 | A1 * | 11/2008 | Weber et al. | 439/541.5 |

FOREIGN PATENT DOCUMENTS

| | | |
|---|---|---|
| CN | 2340100 | 9/1999 |
| DE | 20 2008 001 026 | 3/2008 |
| WO | WO 2009/033641 | 3/2009 |

* cited by examiner

*Primary Examiner* — Ali Alavi

(74) *Attorney, Agent, or Firm* — Cozen O'Connor

(57) ABSTRACT

A lighting device (1) comprising at least one light source (5), at least one base (7) thermally and electrically operationally connected to the light source (5), and at least one bulb fitting (10, 27) provided for receiving the base (7). The base (7) has at least one first heat transfer surface (15) and the bulb fitting (10, 27) has at least one second heat transfer surface (17) in contact with the first heat transfer surface (15) either directly or by way of a foil (16). At least one device (14, 26, 32, 39) is provided for exerting a predefined press force between the first heat transfer surface (15) and the second heat transfer surface (17).

19 Claims, 7 Drawing Sheets

LIGHTING DEVICE HAVING A SOCKET AND BULB FITTING

RELATED APPLICATIONS

This is a U.S. national stage of application No. PCT/EP2009/052626, filed on Mar. 5, 2009.

FIELD OF THE INVENTION

The invention relates to a lighting device comprising at least one light source, at least one base thermally and electrically operationally connected to the light source, and at least one bulb fitting provided for receiving the base.

The invention furthermore relates to a bulb fitting for receiving a base which is electrically and thermally operationally connected to at least one light source.

The invention likewise relates to a base which is electrically and thermally operationally connected to at least one light source.

BACKGROUND OF THE INVENTION

Light sources, in particular semiconductor light sources such as light emitting diodes (LED), frequently reach temperatures during operation which necessitate dissipation of the heat. This can take place by way of a heat sink connected approximately directly to the light source, which means that when the light source is replaced this heat sink also has to be replaced at the same time.

Lighting devices are likewise known in which the light source is electrically and thermally operationally connected to a base and this base is in turn held in a bulb fitting. The heat generated by the light source is however for the most part transferred only inadequately to the bulb fitting, from where it should be transferred to other components of the lighting device, for example heat sinks, housing parts or a coolant circuit. This is due to the fact that in most cases conventional plug or screw bases are used, as are often employed in the case of conventional lamps for mechanical holding and transmission of the electrical energy.

The disadvantage in this situation alongside the poor thermal conductivity with regard to screw bases in particular is moreover the mechanical fixing which can easily become unscrewed due to vibrations or lead to destruction of the lighting device or of the bulb fitting as a result of being overtightened.

SUMMARY OF THE INVENTION

One object of the present invention is to create a lighting device comprising at least one light source, at least one base thermally and electrically operationally connected to the light source, and at least one bulb fitting provided for receiving the base, which avoids the disadvantages of the prior art and in particular permits an easily releasable mounting of the light source, if required, in particular for replacement of the light source, whereby a reliable transmission of electrical energy as well as a secure mechanical mounting and a transfer of thermal output should also be ensured.

Another object of the invention is to create a bulb fitting for receiving a base which is electrically and thermally operationally connected to at least one light source for use in an aforementioned.

Another object of the invention is to provide a base which is electrically and thermally operationally connected to at least one light source.

As the base has at least one first heat transfer surface and the bulb fitting has at least one second heat transfer surface in contact with the first heat transfer surface either directly or by way of a foil, and at least one device is provided for exerting a predefined press force between the first and the second heat transfer surface, an optimized heat transfer between base and bulb fitting is ensured. The magnitude of the press force and also the size and configuration of the heat transfer surfaces are chosen such that the heat transfer is sufficient in order to keep the temperature of the light source within the desired range under the expected operating conditions. As the press force is predefined, this ensures that the heat transfer conditions between the heat transfer surfaces can be set in a reproducible manner. Damage to base or bulb fitting or inadequate heat transfer and also poor electrical contact between these components, such as may occur for example in the case of screw bases if these are screwed in too tightly or too loosely, are thus reliably avoided. A foil in this situation is considered to be a flat element, the thickness of which, in other words the distance between two essentially plane-parallel surfaces, is very small in relation to its lateral dimensions.

As the press force is chosen such that a pressure of between 0.002 $N/mm^2$ and 1.0 $N/mm^2$, preferably between 0.05 $N/mm^2$ and 0.5 $N/mm^2$, by particular preference between 0.08 $N/mm^2$ and 0.3 $N/mm^2$, in particular from approximately 0.1 $N/mm^2$ to 0.2 $N/mm^2$ is exerted on the heat transfer surfaces, under the normal conditions of a base/bulb fitting system both a good heat transfer is made possible as are also sufficient contact reliability and good releasability of the connection in the case of replacement of the light source.

It is especially advantageous if a foil made of a material having good thermal conductivity is arranged between the first heat transfer surface and the second heat transfer surface. This foil can compensate for irregularities or dimensional inaccuracies of the heat transfer surfaces and thus help avoid undesired air pockets between the surfaces. In this situation, foils having a thermal conductivity perpendicular to the surface of greater than 1 W/mK, preferably of greater than 15 W/mK, by particular preference of greater than 50 W/mK are regarded in particular as having good thermal conductivity.

Such materials can for example be ceramic foils, in other words preferably polymer-based foils having a ceramic insert, such as are marketed for example under the name Kerafol, but can also be graphite-based foils or metallic foils, by particular preference made of indium. In this situation, in addition to a high thermal conductivity of greater than 80 W/mK, indium in particular also exhibits the necessary low hardness which enables a good adaptation to the surface of the heat transfer surfaces. Because the contact resistance of ceramic foils changes with pressure, a pressure range in accordance with the preceding claim is particularly advantageous because a good heat transfer is ensured in this way.

As the foil has an adhesive action at least on one side, in particular is coated with an adhesive, the lighting device can be manufactured by using simple means. In particular, any slippage of the foil when inserting the base into the bulb fitting can be simply avoided by these means.

By particular preference the foil is fitted on the base-side first heat transfer surface by means of the adhesive action because this means that when the light source and thus the base are replaced the foil can be replaced more simply than if it is connected to the bulb fitting or is only inserted loosely between base and bulb fitting.

It is advantageous if at least one spring element is provided for exerting the press force on the heat transfer surfaces. Spring elements on the one hand make it possible to achieve a good setting of the press force and on the other hand are well suited to compensate for dimensional tolerances without any excessive force being exerted on one of the components.

It is expedient if at least one, in particular wedge-shaped, fixing element is provided for locking the base in the bulb fitting. By this means the base is held securely in the bulb fitting. Wedge-shaped fixing elements, in other words elements whose cross-section increases along a given line, are particularly well suited for fixing purposes because when they are inserted along this line into a holding element they exhibit a holding force which increases as the insertion depth increases. By this means it is also possible to compensate well for dimensional tolerances of the interacting components.

In an advantageous embodiment of the invention, the base has at least one groove and/or one projection and the bulb fitting has at least one fixing element engaging in the groove and/or in the projection in the operating state. A form-locked connection is thereby established between base and bulb fitting by simple means.

In a further advantageous embodiment of the invention, the bulb fitting has at least one groove and/or one projection and the base has at least one fixing element engaging in the groove and/or in the projection in the operating state. A form-locked connection is also established in this case between base and bulb fitting by simple means.

It is likewise expedient if the base is designed to be approximately circular at least in sections. On the one hand circular components can be manufactured simply, on the other hand the circular section can inserted simply in a circular holding element and the position changed by rotation.

It is furthermore expedient if the base has at least one element for securing the mounting position, in particular for securing against being twisted. This serves to ensure that the electrical contacts and also the beam direction of the light source are correctly positioned during operation.

It is likewise expedient if the in particular wedge-shaped fixing element is capable of being moved by means of a linear movement from a fixing into a non-fixing position and/or from a non-fixing into a fixing position. This constitutes a simple possible way of fixing the base and thus the light source. At the same time, it is easily apparent from the position of the fixing element whether the latter is open or closed. Linear movements can also be performed simply by operating persons which means that operating errors or unergonomic work procedures can be excluded with regard to fixing the base, in particular also with regard to the manufacture of the lighting device.

In a further expedient embodiment of the invention, the in particular wedge-shaped fixing element is capable of being moved by means of a rotational and/or swivel movement from a fixing into a non-fixing position and/or from a non-fixing into a fixing position. Such devices can be manufactured simply. In particular, the guidance of the fixing element can be taken over by the rotational axis which can have a simple design. At the same time, the fixing element is thereby secured by simple means to prevent loss. Rotational and/or swivel movements can also be executed relatively simply by operating persons, which facilitates mounting of the base. In particular, so-called bayonet fittings make use for the most part of a swivel movement of a fixing element. In the case of a bayonet fitting, one element is brought into the locked position in relation to a second element by means of a push-rotational movement, whereby in addition a locking mechanism can also be provided.

As the fixing element is designed as a retaining ring and/or cap nut, a particularly simple and secure means of mounting the base is created.

BRIEF DESCRIPTION OF THE DRAWINGS

The invention will be described in detail in the following with reference to exemplary embodiments. In the drawings.

DETAILED DESCRIPTION OF THE DRAWINGS

Figure 1:
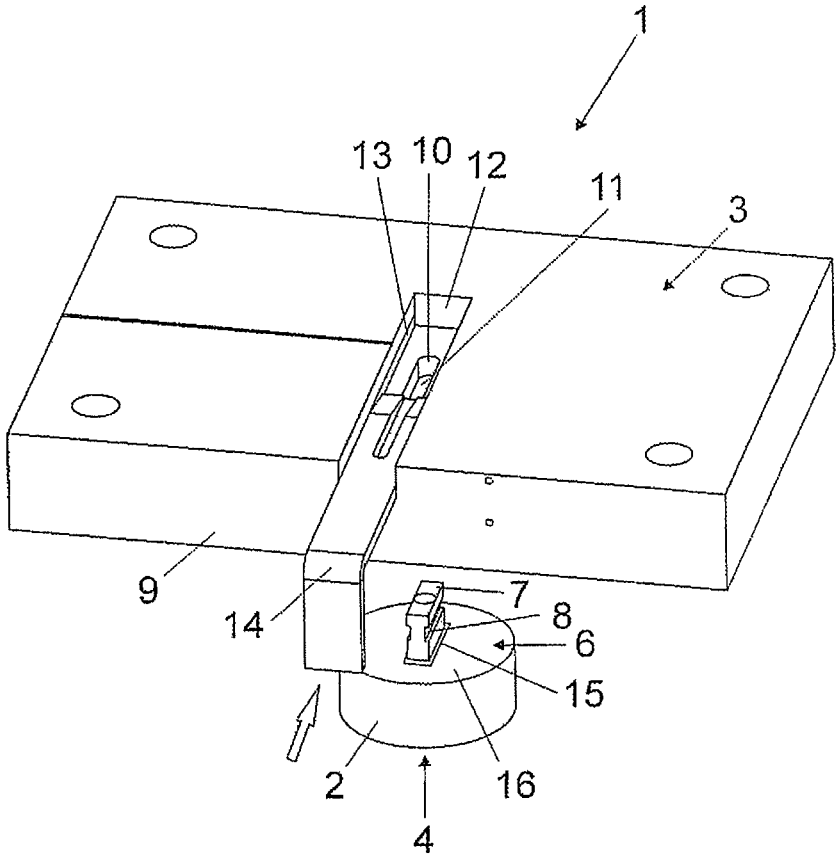
FIG. 1 shows a perspective view of a first exemplary embodiment of a lighting device according to the invention.

FIG. 1 shows a perspective view of a first exemplary embodiment of a lighting device 1 according to the invention. The lighting device 1 comprises a lighting module 2 and a basic element 3.

The lighting module 2 is provided on one side 4 with light emitting diodes (LED) 5, not visible in the figure, as a light source and has on its side 6 facing away from the LEDs 5 a base 7. The base 7 has a rectangular cross-section and has a groove 8 in each case on both sides.

The basic element 3 comprises a heat sink 9 and also a bulb fitting 10 provided for receiving the lighting module 2, which is essentially formed from an elongated hole 11 which is arranged in a recess 12. A forked fixing element 14, which is shown in the open position, is guided in the grooves 13 at the sides of the recess 12. Furthermore, the basic element 3 and/or the lighting module 2 can also comprise further devices which according to the knowledge of the person skilled in the art are required or expedient for operation of the lighting device 1, such as for example driver circuits, power adapters, sensors, optical components or connections to the voltage supply or for controlling lighting functions. The basic element 3 can also essentially be implemented as a heat sink 9.

The lighting module 2 has a heat transfer surface 15, on which is affixed a heat conducting foil 16.

Figure 2:
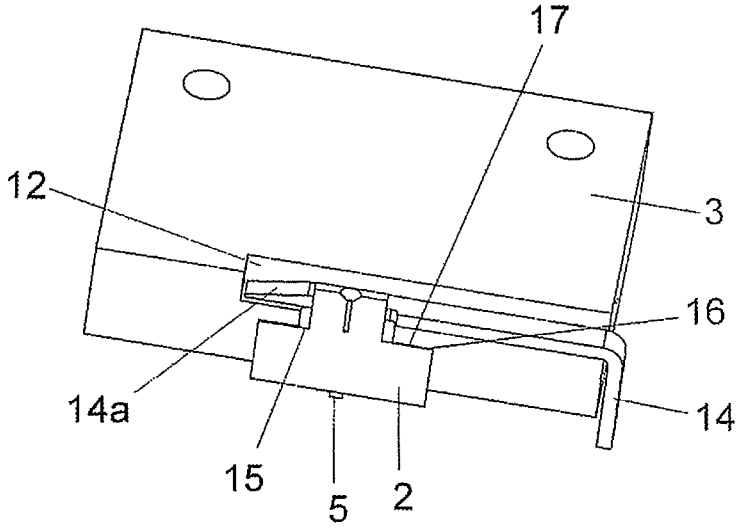
FIG. 2 shows a sectional view of the lighting device according to FIG. 1.

When the lighting module 2 has been inserted completely into the bulb fitting 10, the fixing element 14 is moved in the direction of the arrow and the lighting module 2 is thereby fixed in the basic element 3. This state is shown in a sectional view in FIG. 2. The physical form of the recess 12, of the grooves 8, of the fixing element 14, as well as the thickness of the prongs 14*a* of the fixing element 14 and of the heat conducting foil 16 are chosen such that the predefined press force is exerted between the heat transfer surface 15 of the lighting module 2 and the heat transfer surface 17 of the basic element 3, which predefined press force results in a pressure of 0.2 $N/mm^2$ between the heat transfer surfaces 15, 17.

Figure 3:
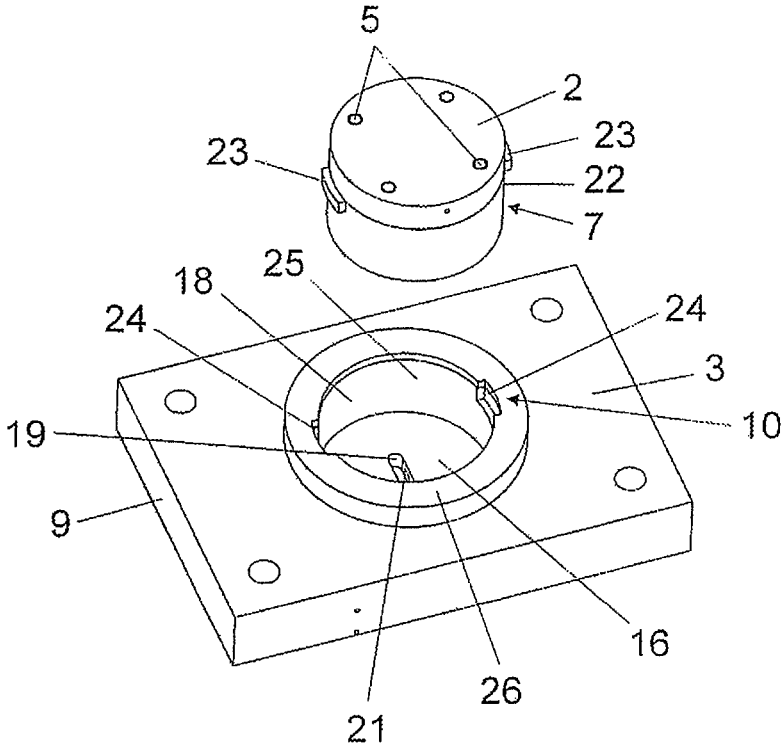
FIG. 3 shows a perspective view of a further exemplary embodiment of a lighting device according to the invention.

FIG. 3 shows an embodiment of the invention wherein the basic element 3 has a circular recess 18 into which the lighting module 2 can be inserted. The recess 18 thereby acts as a bulb fitting 10 and the lighting module 2 in its entirety acts as a base 7. The basic element 3 is constructed similarly to that shown in the first exemplary embodiment and likewise includes the heat sink 9.

A heat conducting foil 16 is arranged at the bottom of the circular recess 18. An elongated hole 19 is similarly provided there which serves to receive an elongated projection (not visible here) of the lighting module 2, by means of which the lighting module 2 is secured against being twisted. In addition, the elongated projection carries contacts (not visible here) which butt against countercontacts 21 of the basic element 3 during operation. At its upper edge 22 the lighting module 3 has two retaining lugs 23 at the sides which engage in corresponding slots 24 in a retaining collar 25 of the basic element 3 which surrounds the recess 18.

Figure 4:
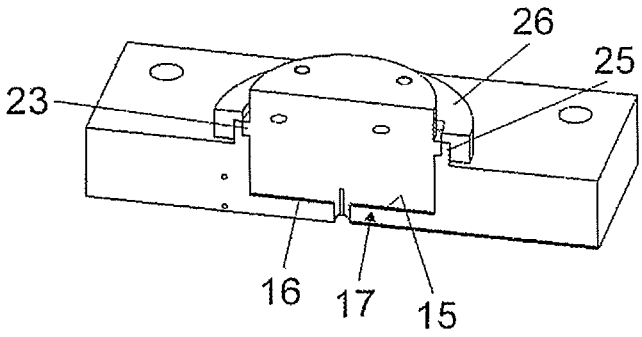
FIG. 4 shows a perspective sectional view of the lighting device according to FIG. 3.
Figure 5:
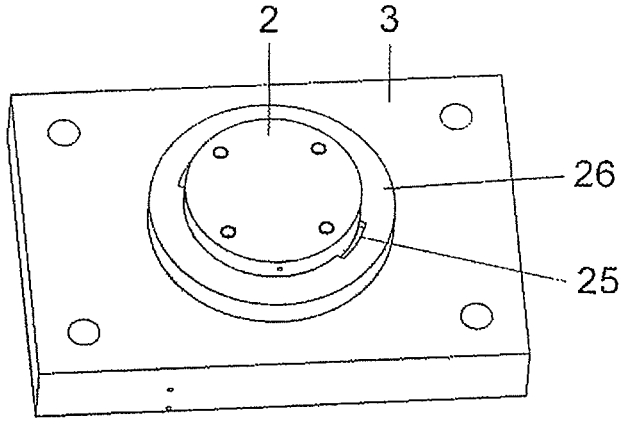
FIG. 5 shows a further perspective view of the lighting device according to FIG. 3.

This state is shown in FIG. 4. A retaining ring 26 is likewise guided in the retaining collar 25. The lighting module 2 is fixed by turning the retaining ring 26 clockwise, which state is illustrated in FIG. 5. In this situation, the retaining ring 26, its guidance in the retaining collar 25, the heat conducting foil 16 as well as the lighting module 2, in particular the retaining lugs 23, are likewise designed such that the heat transfer surface 15 of the lighting module 2 as well as the heat transfer surface 17 of the basic element 3 are pressed against one another with a predefined press force of approx. 0.2 N/mm2. This can be achieved for example likewise by means of a wedge action between the retaining ring 26 and its guidance (not illustrated here) in the retaining collar 25.

Figure 6:
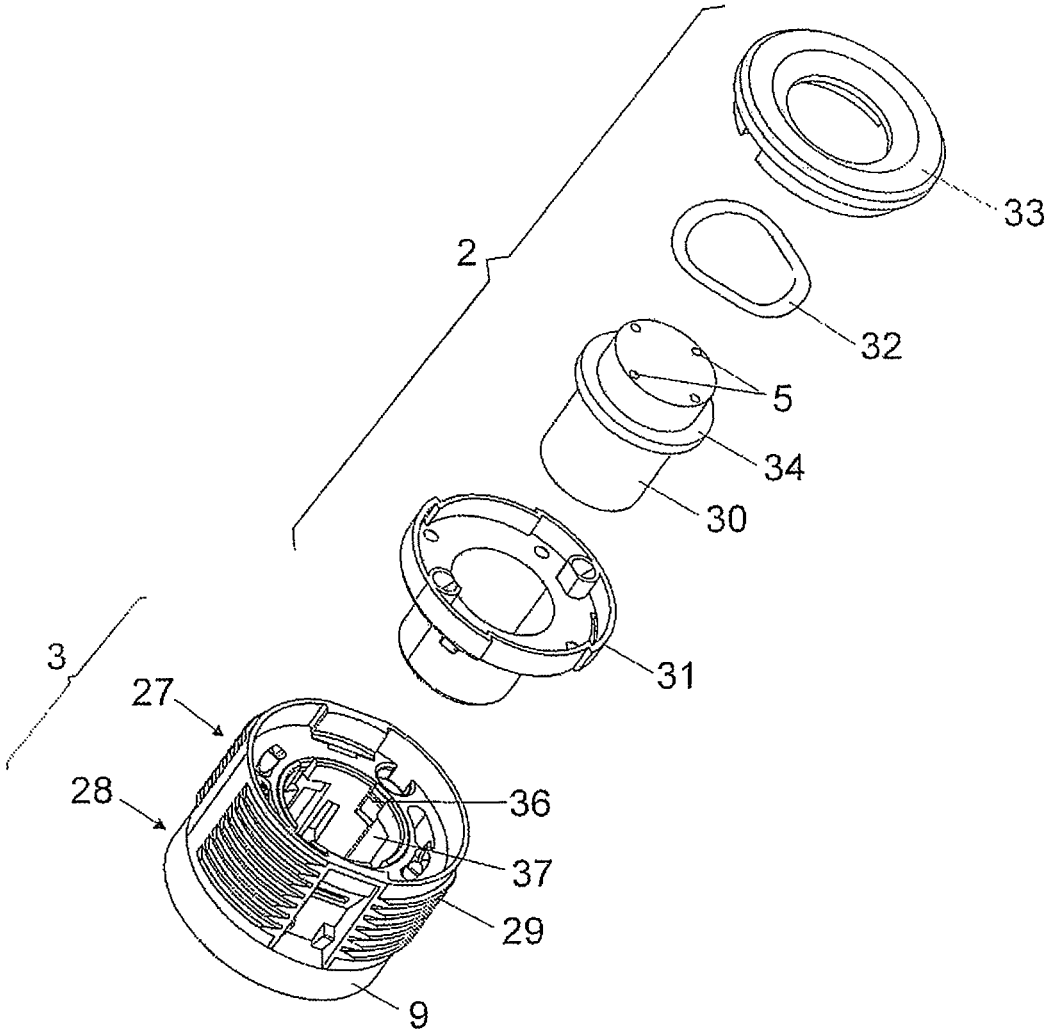
FIG. 6 shows an exploded view of a further exemplary embodiment of a lighting device according to the invention.

A further embodiment of the invention is shown in FIG. 6, wherein a lighting device according to the invention is shown in an exploded view. A cylindrical basic element 3 is provided for receiving a likewise cylindrical lighting module 2. The basic element 3 is in this case of a multi-part design, whereby an upper part 27, which receives the lighting module 2 as a bulb fitting 27, is connected to a lower part 28 which essentially comprises the heat sink 9. The upper part 27 is furthermore used for mounting further add-on parts (not illustrated here), for example a lamp housing or a lamp shade, by means of the thread 29.

The lighting module 2 is also of a multi-part construction and essentially comprises a rotationally symmetrical core 30, an outer housing 31, a circumferential curled spring ring 32 and also a cover ring 33.

Figure 7:
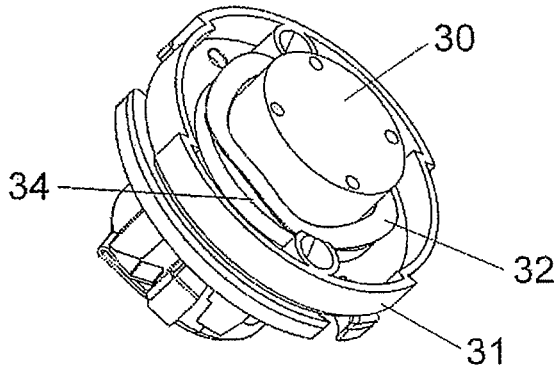
FIG. 7 shows a perspective view of the lighting module of a lighting device according to FIG. 6.

When the lighting module is assembled, firstly the core 30 is inserted into the outer housing 31 and then the spring ring 32 is placed onto a circumferential projection 34 of the core 30 such that the construction shown in FIG. 7 results.

Figure 8:
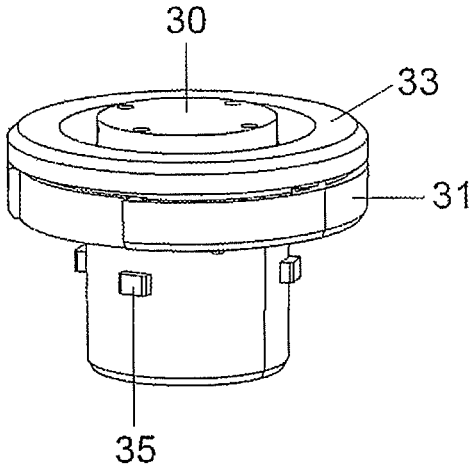
FIG. 8 shows a further perspective sectional view of the lighting module according to FIG. 7.

The cover ring 33 is subsequently screwed together with the outer housing 31 such that the core 30 is mounted in the outer housing 31 so that it is longitudinally displaceable against the resistance of the spring ring 32. The complete lighting module 2 produced in this way is illustrated in FIG. 8.

Figure 9:
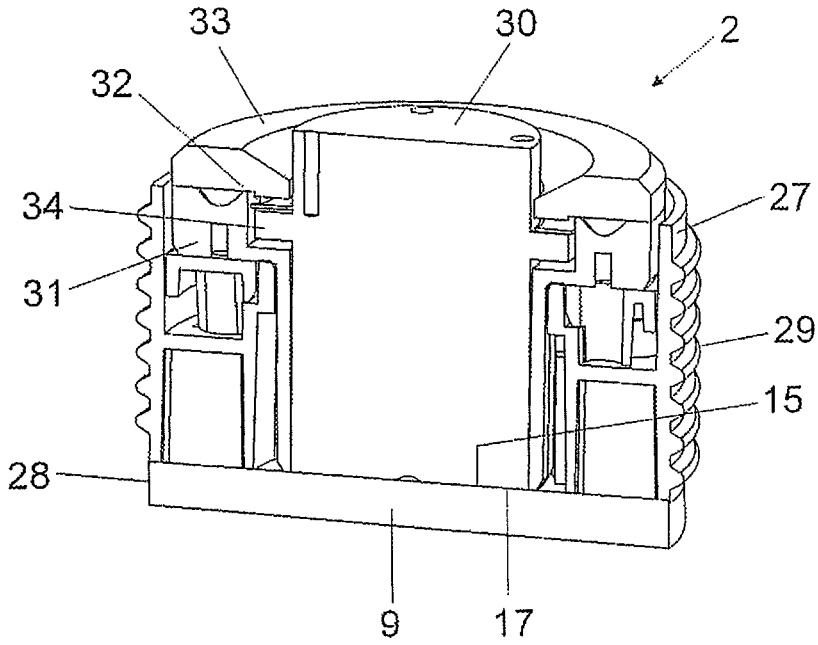
FIG. 9 shows a sectional view of the lighting device according to FIG. 6.

The outer housing 31 has retaining lugs 35 in its lower half which are inserted into grooves 36 in the basic element and when rotated engage in recesses 37, with the result that the outer housing 31 essentially acts as a base. The structure of the lighting device 1 shown in a sectional view in FIG. 9 is thereby achieved.

In this situation, the core 30 is pushed upwards by the heat sink 9 against the resistance of the spring ring 32, which serves to ensure that the desired pressure is attained at the heat transfer surfaces 15, 17.

Figure 10:
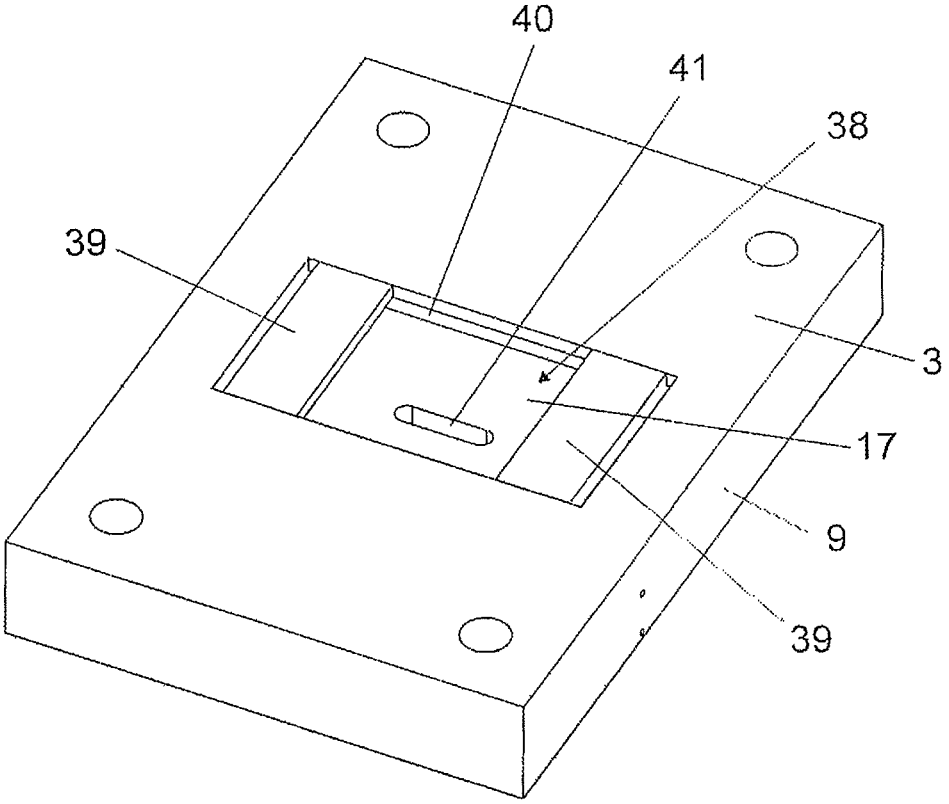
FIG. 10 shows a perspective view of a further exemplary embodiment of a lighting device according to the invention.
Figure 11:
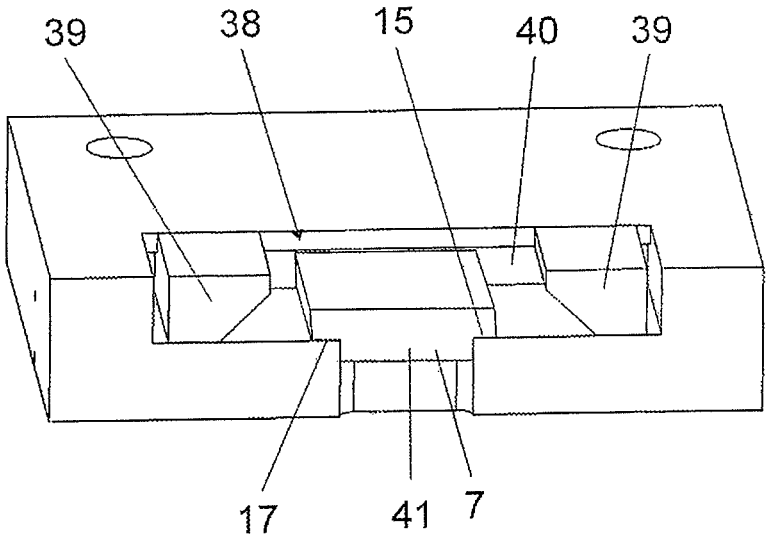
FIG. 11 shows a perspective sectional view of the lighting device according to FIG. 10.

FIG. 10 and FIG. 11 show a further embodiment of the invention. In this situation, the basic element 3 has a rectangular depression 38 in which two fixing elements 39 are guided in grooves 40 at the sides, by means of which a bulb fitting is produced. In an analogous manner to the first exemplary embodiment, the heat sink 9 forms part of the basic element 3. For the purpose of exact positioning of the lighting module 2 (not shown here), an elongated hole 41 is provided in the bottom of the depression 38, into which, in similar fashion to the first exemplary embodiment, the lower part of the base 7 of a lighting module 2 can be inserted.

When the lighting module 2 which in its entirety serves as a base 7 has been inserted into the depression 38, the fixing elements 39 are pushed towards one another and thus as a result of their wedge shape fix the lighting module 2 which thus acts in its entirety as a base. In this situation, the shaping of lighting module 2, fixing elements 39 and depression 38 is chosen such that the heat transfer surface 15 of the lighting module 2 is pressed onto the heat transfer surface 17 of the basic element 3 with the predefined force. Here too, a heat conducting foil 16 can be provided between the heat transfer surfaces 15, 17. The locking of the fixing elements 39 in the closed function is effected by means of inserts (not shown here) which are placed in the depression 38.

Other embodiments of the invention are naturally also conceivable. In particular, the configuration of the basic element 3 and also of the lighting module 2 are shown purely schematically in the exemplary embodiments and may differ considerably from these illustrations in their application. In particular, it is not necessary to choose a rotationally symmetrical form for the lighting module 2.

Useful developments of the invention are also seen to consist, in particular with regard to the linearly acting locking mechanisms such as are shown in the first and fourth exemplary embodiments, in providing mechanisms with which the fixing elements can for their part be secured against opening or by means of which the user is able to recognize whether the locking position has been reached. For this purpose, locking devices in particular but also markings or fixed stops come into consideration. The advantage of a locking device consists in the fact that a defined resistance must first be overcome in order to open or to close the locking device. The heat transfer between the heat transfer surfaces 15, 17 of lighting module 2 and basic element 3 can possibly also be assured without a foil. Through suitable choice of material, it is also possible to reduce the wear on the heat transfer surfaces or, if wear should nevertheless have occurred, this can be compensated for by inserting a new foil. The thickness of the foil can also be used for regulating the press force which means that it is also possible here to adapt to the intended use without needing to make any change to the lighting device at the same time.

The scope of protection of the invention is not limited to the examples given hereinabove. The invention is embodied in each novel characteristic and each combination of characteristics, which includes every combination of any features which are stated in the claims, even if this feature or combination of features is not explicitly stated in the examples.

The invention claimed is:

1. A lighting device comprising:

at least one light source;

at least one base thermally and electrically operationally connected to the at least one light source; and at least one bulb fitting provided for receiving the at least one base comprising a heat sink, wherein the at least one base has at least one first heat transfer surface and the at least one bulb fitting has at least one second heat transfer surface on a surface of the heat sink in contact with the at least one first heat transfer surface either directly or by way of a foil, and at least one device configured to exert a predefined press force between the at least one first heat transfer surface and the at least one second heat transfer surface.

2. The lighting device as claimed in claim 1, wherein the predefined press force is chosen such that a pressure of between 0.002 $N/mm^2$ and 1.0 $N/mm^2$ is exerted on the heat transfer surfaces.

3. The lighting device as claimed in claim 2, wherein the foil at least on one side is coated with an adhesive.

4. The lighting device as claimed in claim 2, wherein the foil has an adhesive action at least on one side.

5. The lighting device as claimed in claim 4, wherein the foil is fitted on the first heat transfer surface by the adhesive action.

6. The lighting device as claimed in claim 1, wherein at least one spring element is provided for exerting the predefined press force on the heat transfer surfaces.

7. The lighting device as claimed in claim 1, wherein at least one fixing element is provided for locking the at least one base in the at least one bulb fitting.

8. The lighting device as claimed in claim 7, wherein said at least one fixing element is wedge-shaped.

9. The lighting device as claimed claim 1, wherein the at least one bulb fitting has at least one groove and/or one projection and the at least one base has at least one fixing element engaging in the at least one groove and/or projection in an operating state.

10. The lighting device as claimed in claim 1, wherein the at least one base is configured to be approximately circular at least in sections.

11. The lighting device as claimed in claim 1, wherein at least one fixing element is provided for locking the at least one base in the at least one bulb fitting.

12. The lighting device as claimed in claim 1, wherein a wedge-shaped fixing element is provided for locking the at least one base in the at least one bulb fitting, and wherein the wedge-shaped fixing element is capable of being moved by a linear movement from a fixing into a non-fixing position and/or from a non-fixing into a fixing position.

13. The lighting device as claimed in claim 1, wherein a wedge-shaped fixing element is provided for locking the at least one base in the at least one bulb fitting, and wherein the wedge-shaped fixing element is capable of being moved by a rotational and/or swivel movement from a fixing into a non-fixing position and/or from a non-fixing into a fixing position.

14. A bulb fitting for receiving a base which is electrically and thermally operationally connected to at least one light source, for use in a lighting device as claimed in claim 1.

15. A base which is electrically and thermally operationally connected to at least one light source, for use in a lighting device as claimed in claim 1.

16. The lighting device as claimed in claim 1, wherein the predefined press force is chosen such that a pressure of between 0.1 $N/mm^2$ to 0.2 $N/mm^2$ is exerted on the heat transfer surfaces.

17. The lighting device as claimed in claim 1, wherein a foil made of a material having good thermal conductivity is arranged between the at least one first heat transfer surface and the at least one second heat transfer surface.

18. The lighting device as claimed in claim 1, wherein the at least one base has at least one groove and/or one projection and the at least one bulb fitting has at least one fixing element engaging in the at least one groove and/or projection in an operating state.

19. The lighting device as claimed in claim 1, wherein the at least one base has at least one element configured to secure the base in a mounting position against being twisted.

* * * * *